US006939583B2

(12) United States Patent
Katsuki et al.

(10) Patent No.: US 6,939,583 B2
(45) Date of Patent: Sep. 6, 2005

(54) FABRIC FOR USE IN INK-JET PRINTING, A METHOD FOR PREPARING SUCH FABRIC AND PRINTED GOODS MADE BY INK-JET PRINTING OF THE FABRIC

(75) Inventors: Toshiharu Katsuki, Fukui-ken (JP); Teruo Fukuda, Fukui-ken (JP); Harukazu Kubota, Fukui-ken (JP)

(73) Assignee: Seiren Co., Ltd., Fukui-ken (JP)

( * ) Notice: Subject to any disclaimer, the term of this patent is extended or adjusted under 35 U.S.C. 154(b) by 152 days.

(21) Appl. No.: 09/912,561

(22) Filed: Jul. 26, 2001

(65) Prior Publication Data

US 2002/0022120 A1 Feb. 21, 2002

(30) Foreign Application Priority Data

Jul. 26, 2000 (JP) ..... 2000-224808

(51) Int. Cl.[7] ..... D06P 5/30; D06P 5/02

(52) U.S. Cl. ..... 427/389.9; 427/209; 427/372.2; 101/488; 8/445; 8/499; 428/32.16; 428/32.24; 428/91; 428/96; 442/67

(58) Field of Search ..... 428/91, 96, 32.16, 428/32.24, 32.25, 32.28, 32.3, 32.34; 101/483, 487, 488; 8/445, 499; 427/372.2, 331, 209, 389.9, 412, 210, 211; 442/64, 65, 66, 67

(56) References Cited

U.S. PATENT DOCUMENTS

| | | | | | |
|---|---|---|---|---|---|
| 5,494,733 | A | * | 2/1996 | Koike et al. | 428/32.16 |
| 5,683,784 | A | * | 11/1997 | Nakao et al. | 428/195 |
| 5,858,514 | A | * | 1/1999 | Bowers | 428/32.24 |
| 6,284,348 | B1 | * | 9/2001 | Suzuki et al. | 428/32.16 |
| 6,326,323 | B1 | * | 12/2001 | Shimano et al. | 442/76 |
| 6,479,412 | B1 | * | 11/2002 | Alfekri et al. | 428/32.16 |
| 6,670,001 | B2 | * | 12/2003 | Kohsaka | 428/32.24 |
| 6,773,769 | B1 | * | 8/2004 | Schulz et al. | 428/32.16 |
| 2001/0014370 | A1 | * | 8/2001 | Graczyk | 427/209 |

FOREIGN PATENT DOCUMENTS

| | | | | |
|---|---|---|---|---|
| EP | 568955 | A1 * | 11/1993 | B41M/5/00 |
| EP | 1 122 068 | A | 8/2001 | |
| JP | 09279486 | A * | 10/1997 | D06P/3/00 |

OTHER PUBLICATIONS

Patent Abstracts of Japan, vol. 2000, No. 02, Feb. 29, 2000 & JP 11 302985A (Taoka Chem Co., Ltd; Meisei Shokai:KK) Nov. 2, 1999 (Abstract).

Patent Abstracts of Japan, vol. 2000, No. 02, Feb. 29, 2000 & JP 11 302987A (Taoka Chem Co., Ltd; Meisei Shokai:KK) Nov. 2, 1999 (Abstract).

Patent Abstracts of Japan, vol. 015, No. 353 (C–0865), Sep. 6, 19991 & JP 03 137283A (Toray Ind Inc), Jun. 11, 1991 (Abstract).

* cited by examiner

*Primary Examiner*—Cheryl A. Juska
(74) *Attorney, Agent, or Firm*—Sughrue Mion, PLLC

(57) ABSTRACT

It is an object of the present invention is to provide fabric for use in ink-jet printing that can prevent not only "ink bleeding", but also "white exposure", "nonuniform coloration" and "back staining". A further object of the present invention is the provision of fabric for use in ink-jet printing, consisting of two textures—napped and ground, which can be evenly ink-jet printed with no variation in color between both, while preventing the occurrence of "white exposure", "nonuniform coloration" and "back staining". Fabric for use in ink-jet printing composed of synthetic fiber or fiber containing synthetic fiber, consisting of two textures—napped and ground, the preparation of which comprises penetration of the ground texture with at least two types of solutions—one containing an ink holding agent of high wettability to synthetic fiber and the other containing an ink holding agent of low wettability to synthetic fiber, and penetration of the napped texture with a solution containing an ink holding agent of high wettability to synthetic fiber (represented as A in the same figure).

2 Claims, 2 Drawing Sheets

FABRIC FOR USE IN INK-JET PRINTING, A METHOD FOR PREPARING SUCH FABRIC AND PRINTED GOODS MADE BY INK-JET PRINTING OF THE FABRIC

FIELD OF THE INVENTION

The present invention relates to fabric for use in ink-jet printing, a method of preparing such fabric and printed goods by ink-jet printing of the fabric, and is particularly concerned with fabric for use in ink-jet printing, which can be printed by an ink-jet printing system with no ink bleeding from design patterns printed on the fabric, sharpness of the outlines of the design patterns and their brilliant color development, as well as no insufficient or uneven ink deposition on the fabric, a method of preparing such fabric and printed goods by ink-jet printing of the fabric.

PRIOR ART

In recent years, printing of fabric by an ink-jet system commonly known as ink-jet printing has made progress in its technological and technical development and improvement.

Compared to its conventional counterpart such as a roller printing or an automatic screen printing, the ink-jet printing system has many advantages, such as allowing fabric to be printed with sharply-outlined and brilliantly-colored design patterns that it can select in a highly flexible way and express using a wide range of colors.

In addition, unlike conventional printing systems which involve screen or roller change for each design pattern lot change, the ink-jet printing system requires no such change, enabling small-lot multi-variety production.

These advantages of the ink-jet printing system has recently led it to attract high attention for its good compliability with the highly fashion-oriented and diversified trend in the textile industry.

Like the conventional printing systems, however, the ink-jet printing system, when applied to fabric, has the fundamental problem of ink bleeding from design patterns printed on the fabric.

In order to solve this problem, therefore, various improvements have been made on the ink-jet printing system for textile use, such as better selection of the material of ink to be applied to fabric and modification to the method of injecting ink onto fabric or treating fabric prior to or upon its ink-jet printing.

Among such improvements, attempts to improve the method of treating fabric prior to or upon its ink-jet printing for the purpose of solving the above problem have been made from earlier times than the others, initially proposing such methods as the one wherein fabric to be ink-jet printed is heated upon injection of ink onto it.

This method, however, has been found to fail to prevent the above-mentioned ink bleeding problem, leading to subsequent proposal of various methods for its solution, among which the most commonly accepted one at the present time is based on the treatment of fabric by applying an ink holding agent to the fabric or for forming an ink holding layer on its surface to be printed prior to its ink-jet printing (as disclosed in Japanese Patent JP-A-61-55277, for example).

The ink holding agent (or layer) applied to (or formed on) fabric according to the above-mentioned method is composed of material which has no affinity for ink to be applied to the fabric, but is capable of holding the ink (or has an ink holding capability).

When ink is then injected onto the fabric during the ink-jet printing process, the ink holding agent (or layer) absorbs the ink and hold it temporarily to prevent the ink dye from bleeding prior to acting to transfer it into the fiber in the next process, in which the fabric is subjected to such treatment as wet heat for dye fixation (or color development).

Therefore, subsequent improvements made on the ink-jet printing for textile use have been focused on betterment of ink holding agents (or layers) to be applied to (or formed on) fabric prior to its ink-jet printing in terms of their ink holding capability for prevention of ink bleeding from printed patterns on the fabric, as well as their contribution to improved dye fixation (color development) in the fabric (as disclosed in Japanese Patent JP-A-3-137283, for example).

Furthermore, such ink holding agents have undergone advanced improvements in their materials and application methods, resulting in great improvement in the solution to the ink bleeding problem.

Such improvements as mentioned above, however, cause an ink holding agent (or layer) having a very high ink holding capability to be mostly applied to (or formed on) only the surface of fabric to be printed, presenting a new problem of the ink applied to the fabric failing to penetrate fully into its inside.

Due to this problem, ink-jet printing on fabric, especially stretchable or napped, results in its inside left uncolored or insufficiently colored, which is noticed as a significant quality defect (hereinafter defined below as "white exposure") for the stretchable or napped fabric when the former is stretched or the latter is touched or bent.

"White exposure" as defined herein refers to a quality defect in stretchable or napped fabric poorly printed with insufficient penetration of dye into its inside, causing its respective uncolored (mainly white) interior or ground texture to be visibly exposed when it is stretched or bent, respectively.

For example, wearing of a bathing suit or T-shirt (made from stretchable fabric printed with design patterns involving quality defect "white exposure") causes the defect to appear on the design patterns of the suit or shirt like fine white cracks.

In addition, lining a structure such as a sofa or automotive seat with a napped fabric (printed with design patterns involving quality defect "white exposure") causes the defect to appear on the design patterns of the fabric with exposure of its white ground at the curved portions of the structure or at other portions where it is touched, causing its napped part to be fallen.

Printed goods with such "white exposure" give such an impression of inferiority in quality that it constitutes a critical defect in their appeal as high-class products.

Some patents have been proposed to allow fabric to be ink-jet printed with prevention of "white exposure" on design patterns printed in the fabric.

One such prior art covering stretchable fabric has proposed ink-jet printing of the fabric under tension to have it stretched during its printing (as disclosed in Japanese Patent JP-A-10-245785, for example).

Another such prior art dealing with napped fabric has proposed printing of the fabric with application of water repellent blended color pasts to its napped texture, followed by placement of its back side onto the surface of a dyeing liquor to dye only its ground texture (as disclosed in Japanese Patent JP-A-9-279486).

However, both prior art methods have failed to achieve substantial solution of the above-mentioned "white exposure" problem, because the former, which involves stretching of fabric, causes the problem of resulting in widened area of the fabric to be printed with its failure to return to its original configuration or its breakage, while the latter, which involves printing of the fabric's napped and ground textures in two separate steps, has the problem of causing variation in color between both textures.

On the other hand, fabric ink-jet printed with insufficient penetration of ink into its inside often suffers uneven color shade and depth, resulting in "nonuniform coloration".

Controlled condition of the inkjet printing system to improve ink penetration into fabric for elimination of these problems of "white exposure" and "nonuniform coloration", such as an increase in the amount of ink to be injected onto fabric, may result in penetration of the ink through the fabric, causing the problem of contaminating the printing equipment (hereinafter referred to as "back staining").

These problems have been hard-to-overcome difficulties inherent to ink-jet printing of fabric containing synthetic fiber.

However, ink-jet printing of such fabric inevitably requires stronger condition setting for increased ink penetration to avoid "white exposure" and "nonuniform coloration", critical defects damaging the appearance quality of the resultant printed goods, although such condition setting results in inevitable occurrence of the "back staining" problem even if the above-mentioned prior art ink holding layer is formed on the fabric before its ink-jet printing process.

Under these circumstances, ink-jet printing of fabric, especially stretchable and raised, has strongly required such treatment of the fabric prior to ink application to it as to allow it to be ink-jet printed with inhibited ink bleeding from the resultant design patterns on it and sufficient ink penetration into its inside, both of which are contradictory to each other.

The compliance with this requirement can only be achieved by the development of a method for treatment of fabric prior to ink-jet application to the fabric, which allows it to be ink-jet printed under a slightly stronger condition than otherwise for increased ink penetration, but without "ink bleeding" or "back staining".

PREFERRED EMBODIMENT OF THE INVENTION

Figure 1:
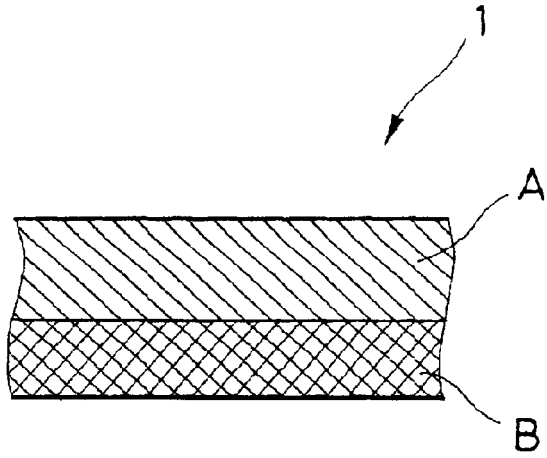
FIGS. 1(*a*) and 1(*b*) shows typical views of fabric for use in ink-jet printing according to the present invention.
Figure 1:
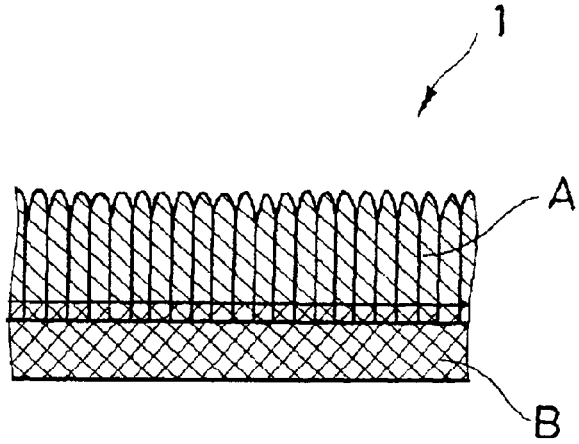

Against the background of the prior art situation, the present invention has been made to solve the above-mentioned problems.

It is therefore an object of the present invention to provide fabric for use in ink-jet printing that can prevent not only "ink bleeding", but also "white exposure", "nonuniform coloration" and "back staining", and a method of preparing such fabric.

A further object of the present invention is the provision of fabric for use in ink-jet printing, consisting of two textures—napped and ground, which can be evenly ink-jet printed with no variation in color between both, while preventing the occurrence of "white exposure", "nonuniform coloration" and "back staining", and a method of preparing such fabric.

As a result of their diligent studies and researches to solve the problems of the prior art, the inventors discovered that these problems with fabric composed of synthetic fiber or fiber containing synthetic fiber could be solved by applying two types of ink holding agents to the fabric, which are different in their wettability and thus their adherence to the synthetic fiber, before injecting ink onto it so as to control the distribution of the ink inside its fiber. Based on this discovery, the inventors accomplished the present invention.

Specifically, the present invention consists in:

fabric for use in ink-jet printing, composed of synthetic fiber or fiber containing synthetic fiber, the preparation of which comprises its penetration with at least two types of solutions—one containing an ink holding agent of high wettability to synthetic fiber and the other containing an ink holding agent of low wettability to synthetic fiber;

(2) fabric for use in ink-jet printing, composed of synthetic fiber or fiber containing synthetic fiber, consisting of two textures—napped and ground, the preparation of which comprises penetration of the ground texture with at least two types of solutions—one containing an ink holding agent of high wettability to synthetic fiber and the other containing an ink holding agent of low wettability to synthetic fiber, and penetration of the napped texture with a solution containing an ink holding agent of high wettability to synthetic fiber;

(3) fabric for use in ink-jet printing as specified in (1) above, wherein said ink holding agent of high wettability to synthetic fiber has at least one type of functional group among hydroxyl, amide and carbonyl;

(4) fabric for use in ink-jet printing as specified in (1) above, wherein said ink holding agent of low wettability to synthetic fiber has amylose or cellulose as its main molecular chain;

(5) fabric for use in ink-jet printing as specified in (1) above, wherein said ink holding agent of high wettability to synthetic fiber and said ink holding agent of low wettability to synthetic fiber are both water-soluble, the ionicity of which is the same as that of the ink to be applied to the fabric or is categorized as nonionic;

(6) a method of preparing fabric for use in ink-jet printing, composed of synthetic fiber or fiber containing synthetic fiber, wherein the fabric is subjected to two sequential processes—the first for application of a solution containing an ink holding agent of high wettability to synthetic fiber so as to cause said solution to penetrate into the fabric and the second for application of an ink holding agent of low wettability to synthetic fiber from the fabric's non-printing side so as to cause said solution to penetrate into the fabric;

(7) a method of preparing fabric for use in ink-jet printing, composed of synthetic fiber or fiber containing synthetic fiber, consisting two textures—napped and ground, wherein the fabric is subjected to two sequential processes—the first for application of a solution containing an ink holding agent of high wettability to synthetic fiber to cause said solution to penetrate into said napped and ground textures and the second for application of a solution containing an ink holding agent of low wettability to synthetic fiber from the fabric's non-printing side to cause said solution to penetrate into the ground texture;

(8) a method of preparing fabric for use in ink-jet printing as specified in (6) above, wherein said solution containing an ink holding agent of high wettability to synthetic fiber is applied to the fabric by padding;

(9) a method of preparing fabric for use in ink-jet printing as specified in (6) above, wherein said solution containing an ink holding agent of low wettability to synthetic fiber is applied to the fabric by a means of applying the solution to one side of it from its non-printing side;

(10) a method of preparing fabric for use in ink-jet printing as specified in (6) above, wherein said solution containing an ink holding agent of high wettability to synthetic fiber ranges in viscosity from 10 to 200 cps; and

(11) printed goods made by ink-jet printing of fabric for use in ink-jet printing as specified in one of (1) to (5) above.

It is naturally understood that the present invention allows combination of two or more of (1) to (5) above, or two or more of (6) to (10) unless such combination departs from the purpose of the present invention, and comprises printed goods made by ink-jet printing of fabric thus prepared.

The fabric for use in ink-jet printing and the method of preparing such fabric according to the present invention, which furnishes it with at least two types of ink holding agents herein defined, can solve the problems of the prior art as mentioned above.

In addition, the concept of the present invention can be similarly applied to fabric consisting of two textures—napped and ground, allowing the two textures to be evenly ink-jet printed with no variation in color between both.

Preferred Embodiments of the Invention

Referring now to the attached drawings, a preferred embodiment of the present invention is illustrated.

The term "fabric" as used herein refers to both types of fabric—one without a napped texture and the other with a napped texture (which can be categorized as a napped fabric consisting of napped and ground textures).

Of the two surfaces of fabric—its front and back, the one to which ink is to be applied for printing is herein referred to as the "printing side", while the other as the "non-printing side". Therefore, in the case of napped fabric used in the present invention, the fabric's face with a napped texture corresponds to the "printing side", while its other face with a ground texture represents the "non-printing side".

The term "wettability" as used herein means a measure of interfacial interaction such as surface tension between a solid (synthetic fiber in the present case) and a liquid (an ink holding agent in its not-yet dried state in the present case).

Specifically, an ink holding agent of high wettability (or highly wettable) to synthetic fiber, when applied to such fiber, is prone to spread over the surface of the fiber (causing the former to wet the latter). On the other hand, an ink holding agent of low wettability (or lowly wettable) to synthetic fiber, when applied to such fiber, is prone to aggregate over the surface of the fiber with reduced area of contact between both (causing the former to be repelled by the latter).

According to the present invention, fabric for use in ink-jet printing has such configuration and function as described below.

Specifically, the fabric of the present invention is fabric composed of synthetic fiber or fiber containing synthetic fiber and penetrated with at least two types of solutions applied to the fabric in two separate steps—one containing an ink holding agent of high wettability to synthetic fiber and the other containing an ink holding agent of low wettability to synthetic fiber.

Of the two types of solutions, the one containing an ink holding agent of low wettability to synthetic fiber, as described later, is applied to fabric 1 from its non-printing side B. (See FIG. 1(*a*)(*b*).)

Figure 2A:
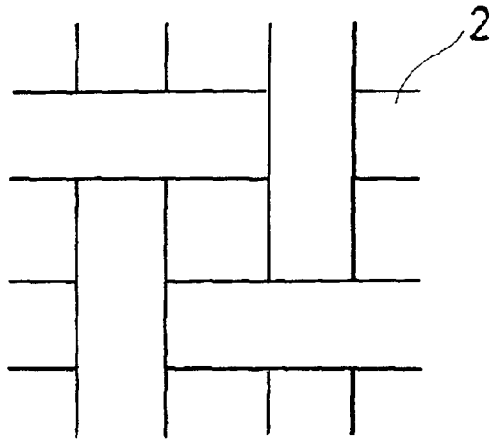
FIGS. 2(*a*), 2(*b*) and 2(*c*) shows typical views of highly and lowly wettable ink holding agents distributed to yarns of fabric as treated according to the present invention.
Figure 2B:
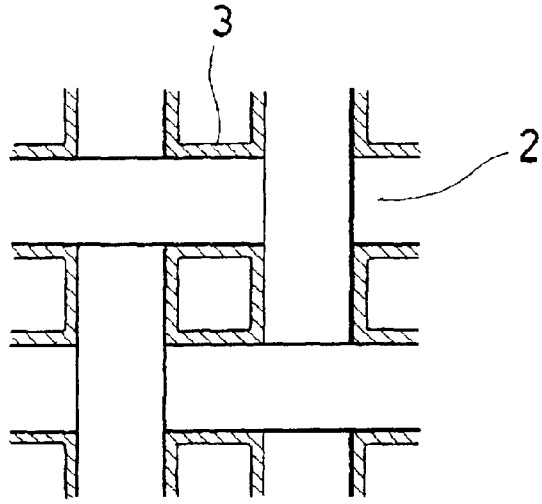
Figure 2C:
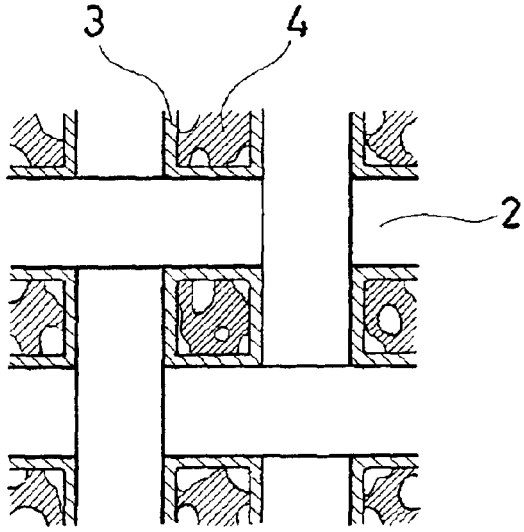

Said ink holding agent of high wettability to synthetic fiber 3, applied to the fabric, is so penetrable to its inside that the agent 3 can cover the surface of each one of its fiber yarns 2 as illustrated in FIG. 2(*b*), achieving uniform distribution almost all over its inside region.

On the other hand, however, said ink holding agent of low wettability to synthetic fiber 4 which is inferior in penetrability to the inside of the fabric than the highly wettable one 3, is locally distributed near the non-printing side of the fabric, aggregating in its yarn-to-yarn space for filling in a network form. (See FIG. 2(*c*).)

The distribution of the highly wettable ink holding agent 3 inside the fabric as described above according to the present invention, wherein the former covers the surface of each of its fiber yarns, allows ink injected onto it to be absorbed onto its entire fiber yarn surface A, achieving its uniform printing.

On the other hand, the lowly wettable ink holding agent 4 distributed near the non-printing side of the fabric B as described above, aggregating in its inter-yarn space for filling in a network form, functions to absorb the ink applied to it that the highly wettable ink holding agent cannot accommodate.

Now, a description is given of the principle of the present invention consisting in the use of such two types of ink holding agents as mentioned above in ink-jet printing of fabric to allow sufficient ink penetration into the inside of the fabric for prevention of such problems as "white exposure" and "nonuniform coloration", but inhibiting such ink penetration through it as to cause the problem of "back staining".

Ink-jet printing of fabric is normally carried out in such a way that ink is injected onto the printing side of the fabric from space above in an approximately perpendicular direction.

The ink, after having reached the printing side of the fabric, penetrates into its inside still in a direction approximately perpendicular to the printing side.

Therefore, ink-jet printing of fabric under a stronger condition for increased ink penetration allows the ink applied to the fabric to penetrate fully into its inside, preventing it against "white exposure" and "nonuniform coloration".

The above-mentioned ink-jet printing system, if carried out as it is, involves a high possibility of causing "back staining", a problem of ink penetration through fabric to its back side.

To deal with this problem, the present invention has proposed the application of an ink holding agent of low wettability to synthetic fiber to the non-printing side of fabric prior to its ink-jet printing, thereby causing the agent to fill its yarn-to-yarn space near that side in a network form for secure catch of the ink penetrated through its inside in an approximately perpendicular direction.

This allows ink-jet printing of fabric to be carried out under a stronger condition for increased ink penetration into the fabric to prevent "white exposure" and "nonuniform coloration" without causing "back staining".

Incidentally, bleeding of the ink from the printed area on the fabric in its planar (horizontal) direction can be perfectly controlled by the above-mentioned highly wettable ink holding agent covered in the present invention, which has a high-level function for preventing such bleeding as herein mentioned earlier.

Accordingly, the present invention allows fabric to be uniformly ink-jet printed with no ink bleeding from the printed area on the fabric, thus providing sharp outlines of the design patterns printed on it and their brilliant color development.

In addition, the present invention enables ink-jet printing of fabric with sufficient ink penetration into its inside, thus preventing such problems as "white exposure" and "non-uniform coloration", but without causing "back staining".

For reference, treatment of fabric with a highly wettable ink holding agent according to the present invention, but followed by further application of a highly wettable ink holding agent to the fabric from its non-printing side, which causes the agent to penetrate into its inside from its non-printing side, results in failure of the agent to fill its yarn-to-yarn space on that side in a network form or densely.

The above reference method is equivalent to treatment of fabric with a highly wettable ink holding agent just to allow the agent to cover its entire yarn surface with no such ink holding agent filling its inter-yarn space as referred to in the present invention for secure catch of the ink penetrated into its inside in an approximately perpendicular direction as mentioned above, eventually causing the problem of "back staining".

Accordingly, in order to solve this "back staining" problem, it is necessary to treat fabric with a lowly wettable ink holding agent that is capable of filling its yarn-to-year space in a network form by applying the agent to the fabric from its non-printing side prior to its ink-jet printing.

Specifically, the substance of the present invention consists in furnishing fabric with two separate ink holding functions—one by application of a highly wettable ink holding agent to the fabric to achieve its uniform printing and the other by application of a lowly wettable ink holding agent to it to prevent its "back staining".

The above description of the present invention can similarly apply to napped fabric covered in the present invention, provided that the fabric should be treated with said two types of solutions in such a way as to cause its napped texture to be furnished only with a highly wettable ink holding agent whenever possible and its ground texture to be penetrated with a solution containing a lowly wettable ink holding agent under careful control of the penetration of the solution to or near the root of the nap at most. [See FIG. 1(*b*).]

Specifically, according to the present invention, the napped texture of the fabric treated with a solution containing a highly wettable ink hold agent has the agent attached to it in such a way as to cover its synthetic fiber, while having a lowly wettable ink holding agent present at or near its nap root only in a slight quantity with little adherence of the agent to it.

The distribution of highly and lowly wettable ink holding agents in the napped and ground textures of the fabric, respectively, in such a way as described above enables the ink injected onto its printing side in an approximately perpendicular direction to penetrate into its napped texture in the direction almost parallel to that of the nap length.

The ink thus penetrated into the napped texture of the fabric is absorbed into the ink holding agent attached to the entire surface of the nap from its top to root, achieving its uniform printing.

According to the present invention, ink-jet printing of the fabric thus treated with highly and lowly wettable ink holding agents under a stronger condition for increased ink penetration allows the ink applied to it to reach its ground texture, allowing its two textures to be uniformly printed with no variation in color between both.

In addition, the napped texture of the fabric treated with a solution containing a lowly wettable ink holding agent according to the present invention has the agent filling its yarn-to-yarn space in a network form, preventing "back staining" that may otherwise occur under the above-mentioned ink-jet printing condition.

The synthetic fiber composing fabric preferred in the present invention includes polyester, polyamide and polyacrylic.

Fabric useful in the present invention, however, can comprise one or more types of synthetic fiber alone, selected from the above listed ones, or combined with other types of fiber such as natural and regenerated.

In addition, the proportion of synthetic fiber contained in fabric useful in the present invention to achieve its purpose in an effective manner is 50% or more, preferably 80% or more.

The present invention, if applied to fabric, wherein the proportion of synthetic fiber is less than 50%, may fail to demonstrate its effectiveness otherwise positively obtainable from the above-mentioned wettability of the two combined types of ink holding agents to the synthetic fiber, causing the fabric to be unevenly ink-jet printed.

Fabric useful in the present invention from a constructional or configurational point of view includes fabric of various constructions and configurations such as woven, knitted and non-woven, among which napped and stretchable fabrics are preferable for the present invention, which has proved to be greatly useful and effective for fabric of such construction or configuration.

Among napped fabrics useful in the present invention are woven and knitted pile fabric (such as moquette, velvet and velveteen), woven and knitted fabric (such as double raschel) finished by raising, and other conventional types of fabric with piles. Stretchable fabric useful in the present invention includes fabric woven and knitted of elastic yarn (such as polyurethane and PBT), crimped yarn and other stretchable yarn conventionally available.

Preferably useful ink holding agents of the present invention can comprise water-soluble substances of excellent safety and stability, which are cost-effective, environmentally-friendly and easy to handle.

Substances generally known as ink holding agents which have high wettability to synthetic fiber are synthetic polymers, while compounds useful as ink holding agents lowly wettable to synthetic fiber mainly comprise natural or semi-synthetic polymers, as similarly defined and used in the present invention.

Among the preferred ink holding agents of high wettability to synthetic fiber according to the present invention are ones which can hold firmly ink applied to fabric until the fabric is subjected to wet heat treatment or other similar process for dye fixation before easily releasing the ink and acting to the utmost for its easy transfer into the fiber of the fabric.

More effective as such ink holding agents are water-soluble polymers molecularly structured with at least one type of functional group among hydroxyl, amide and carbonyl, which are highly hydrophilic.

As specific examples of such ink holding agents of high wettability to synthetic according to the present invention can be given polyacrylamide, polyacrylate, acrylic acid-acrylamide copolymer, polyacrylic acid, polyvinyl alcohol, polyethylene glycol, polypropylene oxide, oxyethylene-oxypropylene copolymer, water-soluble polyester, polyamide, urea resin, polyurethane and starch-acrylic acid copolymer.

Among these polymers, polyacrylamide polyacrylate, acrylic acid-acrylamide copolymer, water-soluble polyester and polyurethane, which have excellent covering capabilities, are preferably useful for the present invention, although they and others should be evaluated for optimality before final selection in consideration of the type of the ink to be applied to fabric, the type and proportion of synthetic fiber contained in the fabric and other factors.

On the other hand, the useful ink holding agents of low wettability to synthetic fiber according to the present invention are supposed to function as absorbers of the ink injected onto fabric, left unabsorbed into the highly wettable ink holding agent similarly applied to the fabric before its ink-jet printing. Therefore, among such ink holding agents preferable for the present invention are ones which are maximally prone to absorb or capable of absorbing the ink applied to fabric for ink-jet printing.

Accordingly, more effective as such lowly wettable ink holding agents for the present invention are polymer compounds which can form hydrogen bonds with the ink absorbed into them, most ideally gelling to build a network structure, like ones which have amylose and cellulose as their main molecular chains.

As specific examples of such ink holding agents of low wettability to synthetic according to the present invention can be given natural polymers such as starch, guar gum and sodium alginate, and semi-synthetic polymers such as methylcellulose, ethylcellulose, hydroxyethylcellulose, carboxymethylcellulose, carboxymethyl starch.

Among these natural and semi-synthetic polymers, carboxymethylcellulose is preferable for the present invention in terms of its excellent gelling characteristic, although they and others should be evaluate for optimality for final selection in consideration of the type of the ink to be applied to fabric and the type and proportion of synthetic fiber contained in the fabric.

In addition, the ionicity of the highly and lowly wettable ink holding agents to be usefully applied to fabric according to the present invention is the same as that of the ink to be applied to the fabric or preferably categorized as nonionic.

The application of an ink holding agent to fabric according to the present invention, the ionicity of which is opposite to that of ink to be applied to the fabric, results in formation of an ionic bond between the agent and the ink, which becomes stronger than necessary, preventing easy transfer of the latter into the fiber of the fabric with resultant deterioration in deposition of the ink dye into the fabric fiber.

Such an ink holding agent is to be washed out with ink contained in the agent from the printed fabric while it is soaped after its dye fixation, generating a large amount of ink failing to contribute to its printing, with marked reduction in its ink deposition efficiency.

The method of preparing fabric for use in ink-jet printing according to the present invention is illustrated.

According to the present invention, fabric, as a process for its pretreatment, can be subjected to scouring, bleaching (as required) and other normally practiced steps necessary to make it ready for application of a solution containing an ink holding agent of high or low wettability to synthetic fiber according to the present invention.

Napped fabric useful in the present invention can also be pretreated for its scouring, heat-setting and, if necessary, raising in accordance with the same procedures as normally practiced for pretreatment of such fabric to make it ready for application of a solution containing an ink holding agent of high or low wettability to synthetic fiber according to the present invention.

A solution containing an ink holding agent useful in the present invention, whether highly or lowly wettability to synthetic fiber, can be prepared by adding to it a solution which contains more or one of pH controllers, surface active agents, leveling agents, carriers, shade deepeners, penetrants, catalysts, oil absorbents, antiseptic agents, holding agents, plasticizers, thermosetting resins, cross-linking agents, infrared absorbents, ultraviolet absorbents, light resistance (fastness) improvers, antioxidants, extender pigments, fluorescent whitening agents, adsorbents, antireductants, sequestering agents, fillers, moisture absorbents, electrolytes, perfumes, nntibacterial agents, deodorants, insecticides and other chemicals if necessary to improve the quality of the resultant printed goods, but not to the extent inconsistent with the purpose of the present invention.

Further, a solution containing an ink holding agent of high or low wettability to synthetic fiber to be applied to fabric according to the present invention can be prepared with addition of coloring material (such as dye or pigment) to the solution for ground dyeing of the fabric.

Such a solution of the present invention can be applied to fabric by a method of applying the solution to both sides of the fabric such as dipping or padding, or a method of applying the solution to either side of the fabric such as flat screen, rotary screen, roller printing, coating, spraying or laminating.

According to the present invention, said two types of solutions—one containing an ink holding agent of high wettability to synthetic fiber and the other containing an ink holding agent of low wettability to synthetic fiber—can be applied to fabric in two separate processes.

The first process involves treatment of fabric by application of a solution containing an ink holding agent of high wettability to synthetic fiber.

The application of the solution to fabric can be achieved using any one of the methods listed above for such application, although the one based on padding (which is also referred to as a mangle-pad method) is preferable for the present invention, because it allows the solution to be applied not only all over the surface of the fabric, but also to each of its fiber yarns.

When specifically described on a production basis, this process can be carried out, for example, by subjecting fabric to application of a solution containing a highly wettable ink holding agent by a mangle-pad method, followed by thermal drying of the fabric at 100–200° C. for 1 to 10 minutes for fixation of the ink holding agent deposited on the fabric in such a way as to cover the surface of its synthetic fiber yarns.

According to the present invention, this first process can also be accomplished by using a means of applying said solution to one side of fabric, although it is preferably applied to the fabric from its printing side to allow the highly wettable ink holding agent to be distributed near that side.

The second process involves treatment of the fabric by application of a solution containing a lowly wettable ink holding agent from its non-printing side.

As mentioned herein earlier, the present invention has proposed applying a solution containing a lowly wettable ink holding agent to fabric so that the ink holding agent is distributed into the inside of the fabric locally closer to its non-printing side, allowing the agent to take more effect in preventing the ink applied to it from penetrating through it to its back (defined herein as "back staining").

Accordingly, according to the present invention, a solution containing an ink holding agent of low wettability to synthetic fiber is to be preferably to applied to fabric from its non-printing side, thus by using a means of applying the solution to one side of it.

When specifically described on a production basis, this process can be carried out, for example, by subjecting fabric to application of a solution containing a lowly wettable ink holding agent by a rotary screen printing method, followed by thermal heating of the fabric at 100–200° C. for 1 to 10 minutes for fixation of the ink holding agent aggregated in the fabric's yarn-to-yarn space in a network form.

In addition, according to the present invention, the first and second processes are preferably carried out in that order so as to ensure positive covering of the fabric yarn surface with a highly wettable ink holding agent.

Referring to FIG. 2, there are shown typical views of highly and lowly wettable ink holding agents distributed to yarns of fabric as treated in the above-mentioned first and second processes according to the present invention.

In the first process, fabric inter-woven or inter-knitted with synthetic fiber yarn [FIG. 2(*a*)] in whole or part according to the present invention is treated with a solution containing a highly wettable ink holding agent, which penetrates into the fabric, causing the ink holding agent to be deposited onto the synthetic yarn in such a way as to cover its surface as illustrated in [FIG. 2(*b*)].

The fabric is then subjected to the second process, wherein a solution containing a lowly wettable ink holding penetrates into it from its non-printing side, causing the ink holding agent to be aggregated and fixed in its yarn-to-yarn space for filling in a network form as illustrated in [FIG. 2(*c*)].

The above-described concept of the present invention can be similarly applied to napped fabric useful in the present invention as mentioned herein earlier, provided that the second process for application of a solution containing a lowly wettable ink holding agent to the fabric is carried out with such care as to prevent its napped texture from being penetrated with the solution, at least limiting the penetration of the solution to the root of the nap. [See FIG. 1(*b*).]

The viscosity of a solution containing an ink holding agent of high or low wettability to synthetic fiber according to the present invention is preferably adjusted to 10 to 200 cps for application to fabric in the above-mentioned first or second process, respectively, so as to facilitate uniform deposition of the ink holding agent on the surface of each yarn of the fabric.

The application of such a solution to fabric with its viscosity adjusted below 10 cps tends to result in failure of the solution to stick to the yarn of the fabric properly, causing migration of the ink holding agent and its insufficient deposition on the fabric yarn.

Conversely, if such a solution with its viscosity adjusted above 200 cps is applied to fabric, the solution fails to penetrate into the fabric uniformly with uneven deposition of the ink holding unit on the fabric yarn.

Fabric (including napped fabric) prepared as described according to the present invention is ready for ink-jet printing to furnish it with appropriate colors and design patterns.

The ink-jet printing of fabric according to the present invention can be achieved by continuous systems such as charge modulating type, micro dotting type, electrostatic charge control type, ink mist type and magnetic ink type, and on-demand systems such as stemme type, pulse jet type, bubble jet type, electrostatic suction and dry jet type.

The fabric thus ink-jet printed with appropriate colors and design patterns is normally subjected to thermal treatment or other necessary treatment to finish it into final printed goods.

The condition for the thermal treatment of ink-jet printed fabric according to the present invention varies depending upon the composition of the fabric and the physical properties of the dyes used for its ink-jet printing, although it is normally treated under wet heat at 100–200° C.

EXAMPLES

The present invention will be understood more readily by reference to the following examples of its embodiments; however, these examples are intended to further illustrate the present invention and are not to be construed to limit the scope of the present invention.

Example 1

A solution containing an ink holding agent of high wettability to synthetic fiber (hereinafter referred to as "Solution A1") was prepared according to the following recipe:

| | |
|---|---|
| PVA205 (Kuraray-made synthetic polymer based on polyvinyl alcohol) | 3 parts |
| REACTANT MS (Uni Kasei-made antireductant) | 1 part |
| Malic acid (diluted with water to 50%) | 0.5 part |
| UNIGUARD E-200N (Dai-ichi Kogyo Seiyaku-made light fastness improver) | 1 part |
| Water | Rest |
| Total | 100 parts |
| Viscosity: 80 cps | |

Napped polyester 100% double raschel knitted fabric conventionally desized and scoured was treated with Solution A1 by a mangle-pad method. The fabric was then subjected to hot-air drying at 180° C. for 3 minutes.

A solution containing an ink holding agent of low wettability to synthetic fiber (hereinafter referred to as "Solution B1") was prepared according to the following recipe:

| | |
|---|---|
| FINE GUM SP-1 (Dai-ichi Kogyo Seiyaku-made semi-synthetic polymer based on carboxymethylcellulose) | 3 parts |
| REACTANT MS (Uni Kasei-made antireductant) | 1 part |
| Malic acid (diluted with water to 50%) | 0.5 part |
| UNIGUARD E-200N (Dai-ichi Kogyo Seiyaku-made light fastness improver) | 1 part |
| Water | Rest |
| Total | 100 parts |

Solution B1 was applied to the Solution A treated fabric from its non-printing side by a screen printing method.

The fabric was then subjected to hot-air drying at 180° C. for 3 minutes.

After the drying, the fabric was ink-jet printed with ink (prepared as "Ink 1" according to the recipe given below) under the condition set as specified below.

| | | |
|---|---|---|
| Ink 1 | C.I. Disperse Red 127 | 5 parts |
| | Ionic surface active agent | 4 parts |
| | SHIN-ETSU SILICONE KM-70 (Shin-Etsu Chemical-made defoaming agent | 0.05 part |
| | Ethylene glycol | 3 parts |
| | Silicic acid | 0.1 part |
| | Ion exchanged water | Rest |
| | Total | 100 part |
| | Ink-jet printing condition | |
| | Ink-jet printer: On-demand serial scanning type | |
| | Nozzle diameter: 50 $\mu$m | |
| | Driving voltage: 100 V | |
| | Frequency: 5 kHz | |
| | Resolution: 360 dpi | |

The fabric thus ink-jet printed was then subjected to wet heat treatment at 180° C. for 10 minutes.

After the wet heat treatment, the fabric was immersed in a soaping solution prepared according to the following recipe for treatment with a liquor ratio of 100:1 at 80° C. for 30 minutes before being dried.

| | |
|---|---|
| Soaping solution Sodium hydroxide | 1 part |
| LIPOTOL TC-300 (Nicca Chemical-made soaping agent) | 0.02 part |
| Warm water | Rest |
| Total | 100 parts |

Example 2

A solution containing an ink holding agent of high wettability to synthetic fiber (hereinafter referred to as "Solution A2") was prepared according to the following recipe:

| | |
|---|---|
| Marpozol M-1 (Matsumoto Yushi-made synthetic polymer based on polyacrylate) | 3 parts |
| REACTANT MS (Uni Kasei-made antireductant) | 1 part |
| Malic acid (diluted with water to 50%) | 0.5 part |
| UNIGUARD E-200N (Dai-ichi Kogyo Seiyaku-made light fastness improver) | 1 part |
| Water | Rest |
| Total | 100 parts |
| Viscosity: 50 cps | |

This example was pursuant to Example 1 except for the use of napped polyester 80%/cotton 20% knitted fabric instead of napped polyester 100% knitted fabric and Solution A2 instead of Solution A1.

Example 3

A solution containing an ink holding agent of low wettability to synthetic fiber (hereinafter referred to as "Solution B2") was prepared according to the following recipe:

| | |
|---|---|
| KIPROGUM F500 (Nippon Starch Chemical-made natural polymer based on starch) | 5 parts |
| REACTANT MS (Uni Kasei-made antireductant) | 1 part |
| Malic acid (diluted with water to 50%) | 0.5 part |
| UNIGUARD E-200N (Dai-ichi Kogyo Seiyaku-made light fastness improver) | 1 part |
| Water | Rest |
| Total | 100 parts |

This example was pursuant to Example 1 except for the use of Solution B2 instead of Solution B1.

Example 4

This example was pursuant to Example 1 except for the use of polyester 100% tricot fabric instead of napped polyester 100% knitted fabric.

Example 5

This example was pursuant to Example 1 except for the use of cation dyeable polyester 95%/polyurethane 5% stretchable knitted fabric instead of napped polyester 100% knitted fabric.

Comparative Example 1

This comparative example was pursuant to Example 1 except for the use of Marpolose M-25 (Matsumoto Yushi-made semi-synthetic polymer based on methylcellulose) instead of PVA205 (synthetic polymer) in the recipe of Solution A.

Comparative Example 2

This comparative example was pursuant to Example 1 except for the omission of the process for application of Solution A to the fabric.

Evaluation

The ink-jet printed goods obtained in Examples 1–5 and Comparative Examples 1–2 were evaluated for five items—(1) ink penetration, (2) shade depth, (3) Back staining, (4) nonuniform coloration and (5) white exposure as described below to confirm the effectiveness of the present invention.

(1) Ink penetration—The ink-jet printed goods were measured for ink penetration using an optical microscope to determine their respective ink penetration degrees according to the following formula:

Ink penetration degree (%)=Ink penetration depth/fabric thickness (pile/nap length)×100, which yields a higher value for deeper ink penetration.

(2) Shade depth—The ink-jet printed goods were measured for surface shade depth reflectance using a spectrophotometer (MINOLTA CM-1000R) to determine their respective K/S values, which become larger for higher shade depth.

(3) Back staining—The ink-jet printed goods were visually rated for ink staining on their back sides according to the following three-grade scale:

○: No back staining

Δ: Slight back staining, but acceptable

X: Back staining to unacceptable extent (4) Nonuniform coloration—The ink-jet printed goods were visually rated for nonuniform coloration according to the following three-grade scale:

○: No nonuniform coloration

Δ: Slight nonuniform coloration, but acceptable

X: Nonuniform coloration to unacceptable extent (5) White exposure—The ink-jet printed goods were visually rated for white exposure according to the following three-grade scale:

○: No white exposure

Δ: Slight white exposure, but acceptable

X: White exposure to unacceptable extent

TABLE 1

| | Ink penetration | Shade depth | Back staining | Non-uniform coloration | White exposure |
|---|---|---|---|---|---|
| Example 1 | 92 | 1.72 | ○ | ○ | ○ |
| Example 2 | 88 | 1.64 | ○ | Δ | ○ |
| Example 3 | 92 | 1.72 | ○ | ○ | ○ |
| Example 4 | 88 | 1.80 | ○ | ○ | ○ |
| Example 5 | 90 | 1.82 | ○ | ○ | ○ |
| Comparative Example 1 | 50 | 1.78 | ○ | ○ | X |
| Comparative Example 2 | 90 | 0.80 | X | X | Δ |

Results of the Evaluation

As can be seen from Table 1, the results of the evaluation show that the fabric treated with a highly wettable ink holding agent on its printing side and a lowly wettable ink holding agent on its non-printing side according to the present invention can be ink-jet printed to provide high appearance quality printed goods excellent in terms of ink penetration, shade depth, back staining, nonuniform coloration and white exposure.

Effects of the Invention

The present invention is effective not only in solving the conventional problem involved in ink-jet printing of fabric requiring inhibition of ink bleeding from design patterns printed on the fabric and ink penetration into its inside to be achieved at the same time, both of which are contradictory to each other, but also in ensuring its ink-jet printing without problems such as white exposure, nonuniform coloration and back staining that occur otherwise.

The effectiveness of the present invention is particularly marked when it is applied to stretchable and napped fabric. The present invention enables fabric to be ink-jet printed with sufficient ink penetration into the inside of the fabric to form color design images of high shade depth on it, promising to find application in clothing such as swimming wear and T-shirt, industrial material such as automotive upholstery and interior furnishing material such as tapestry, carpet and seat cloth.

What is claimed is:

1. A method of in ink jet printing fabric, said fabric comprising yarn having one or more types of synthetic fiber alone, or combined with non-synthetic fiber, comprising:

applying a solution containing an ink holding agent of high wettability to said synthetic fiber so as to cause said solution to penetrate into the fabric, thereafter, applying an ink holding agent of low wettability to said synthetic fiber from the fabrics nonprinting side, so as to cause said solution to penetrate into the fabric, ink jet printing onto the fabric, applying heat treatment to the fabric, and thereafter providing a soaping treatment.

2. A method of ink jet printing fabric, said fabric comprising yarn having one or more types of synthetic fiber alone, or combined with non-synthetic fiber, consisting of two textures napped and ground, comprising:

applying a solution containing an ink holding agent of high wettability to said synthetic fiber to cause said solution to penetrate into said napped and ground textures, thereafter, applying a solution containing an ink holding agent of low wettability to said synthetic fiber from the fabric's non-printing side to cause said solution to penetrate into the ground texture, ink jet printing onto the fabric, applying heat treatment to the fabric, and thereafter providing a soaping treatment.

* * * * *